US007593662B2

(12) United States Patent
Hashimoto

(10) Patent No.: US 7,593,662 B2
(45) Date of Patent: Sep. 22, 2009

(54) IMAGE-FORMING DEVICE HAVING COOLING MECHANISM FOR COOLING A READING UNIT WITHOUT OVERCOOLING A FIXING UNIT

(75) Inventor: Yohei Hashimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/838,330

(22) Filed: Aug. 14, 2007

(65) Prior Publication Data

US 2008/0050144 A1 Feb. 28, 2008

(30) Foreign Application Priority Data

Aug. 28, 2006 (JP) ..... 2006-231042

(51) Int. Cl.
*G03G 21/20* (2006.01)

(52) U.S. Cl. ..... 399/92

(58) Field of Classification Search ..... 399/92, 399/94

See application file for complete search history.

(56) References Cited

U.S. PATENT DOCUMENTS

| | | | | |
|---|---|---|---|---|
| 2003/0053818 | A1* | 3/2003 | Kimura | 399/94 |
| 2005/0078976 | A1* | 4/2005 | Deguchi et al. | 399/92 |
| 2006/0093395 | A1* | 5/2006 | Igarashi et al. | 399/101 |
| 2006/0159494 | A1* | 7/2006 | Hirai et al. | 399/303 |

FOREIGN PATENT DOCUMENTS

| | | | |
|---|---|---|---|
| JP | 5-224499 | A | 9/1993 |
| JP | 10-268735 | A | 10/1998 |
| JP | 11-084962 | A | 3/1999 |
| JP | 11-282327 | A | 10/1999 |
| JP | 2001-063890 | A | 3/2001 |
| JP | 2001-235998 | A | 8/2001 |
| JP | 2002-040907 | A | 2/2002 |
| JP | 2002-123138 | A | 4/2002 |
| JP | 2002-311763 | A | 10/2002 |
| JP | 2002-357937 | A | 12/2002 |
| JP | 2004-199007 | A | 7/2004 |
| JP | 2006-072290 | A | 3/2006 |

* cited by examiner

*Primary Examiner*—Quana M Grainger
(74) *Attorney, Agent, or Firm*—Banner & Witcoff, Ltd.

(57) ABSTRACT

An image-forming device includes a casing, a driving roller, a conveying belt, a photosensitive unit, a fixing unit, a reading unit, a fan, and a first partition wall. The casing has a wall formed with an air inlet port and defines an inner space. The air inlet port has a top end portion and a bottom end portion. The photosensitive unit is configured to form a predetermined pattern on the conveying belt. The fixing unit has a top edge portion and a bottom edge portion. The reading unit is provided adjacent to the driving roller and is configured to read a predetermined pattern formed on the conveying belt. The fan is provided on an upper section of the inner space. The fan transfers air from inside the casing to outside the casing. The first partition wall is located in the upper section of the inner space. The fan is provided on one side of the first partition wall and the fixing unit is provided on another side thereof. The first partition wall has a bottom end. The bottom end of the first partition wall is positioned below the top edge portion of the fixing unit and above the upper part of the conveying belt. The air inlet port is vertically in a lower position than the fan.

21 Claims, 6 Drawing Sheets

IMAGE-FORMING DEVICE HAVING COOLING MECHANISM FOR COOLING A READING UNIT WITHOUT OVERCOOLING A FIXING UNIT

CROSS REFERENCE TO RELATED APPLICATION

The present application claims priority from Japanese patent application No. 2006-231042, which was filed on Aug. 28, 2006, the disclosure of which is herein incorporated by reference in its entirety.

BACKGROUND OF THE INVENTION

1. Field of the Invention

The present invention relates to an electrophotographic image-forming device including a laser printer or a copying machine and, more particularly to a direct tandem-type image-forming device.

2. Description of the Related Art

In a direct-type image-forming device, typically, a developer image formed on a photosensitive drum is transferred to a recording sheet which has been conveyed by a conveying belt. After that, the developer image is heated by a fixing unit so as to be fixed on the recording sheet, thereby forming an image on the recording sheet.

Hence, a large amount of heat is generated in the fixing unit of the electrophotographic image-forming device. In order to cool the heat of the fixing unit, Japanese Patent Application Publication No. H10-268735 discloses that an image-forming device is formed with an air inlet port and is provided with an exhaust fan. The air inlet port is formed on the casing, is positioned below the fixing unit in the casing and takes cooling air into the casing. The exhaust fan is provided above the fixing unit and transfers the cooling air, which has cooled inner units including the fixing unit, out of the casing.

SUMMARY

In an image-forming device, a correction patch image having a predetermined pattern is periodically formed on a conveying belt. The patch image is read by a sensor such as an optical sensor, so that the operational control over various units is corrected based on the result read by the sensor. This prevents the quality of the image formed on a recording sheet from deteriorating.

The sensor is disposed near a driving roller so that the patch image is read on the driving roller, where the behavior of the conveying belt is stable. The driving roller is disposed near the fixing unit, which means that the sensor disposed near the driving roller is under the strong influence of the heat generated from the fixing unit. This causes the sensor to malfunction. In order to reduce the influence of the heat, some sort of cooler for cooling the sensor is required.

In response to this situation, Japanese Patent Application Publication No. 10-268735 proposes that the inlet port for taking in cooling air is formed below the fixing unit so as to cool the sensor. However, in the case where the fixing unit and the sensor are arranged to be close to each other, it is impossible to cool only the sensor; the fixing unit is unavoidably cooled together.

Further, a larger amount of cooling air is taken in so as to cool the sensor adequately, and the fixing unit is then cooled excessively. This causes insufficient heat to be provided for fixing the developer image on a recording sheet.

In view of the foregoing, it is an object of the invention to provide an image-forming device capable of cooling a reading unit such as an optical sensor adequately without cooling a fixing unit excessively.

To achieve the above and other objects, one aspect of the invention provides an image-forming device including a casing, a driving roller, a conveying belt, a photosensitive unit, a fixing unit, a reading unit, a fan, and a first partition wall. The casing has a wall formed with an air inlet port and defines an inner space. The air inlet port has a top end portion and a bottom end portion. The driving roller is provided in the casing and defines an axial direction. The conveying belt is circularly movably supported on the driving roller and is configured to convey a recording sheet in a sheet conveying direction perpendicular to the axial direction. The photosensitive unit is provided above the conveying belt and has at least one photosensitive drum configured to form a developer image to be transferred onto the recording sheet on the conveying belt. The photosensitive unit is configured to form a predetermined pattern on the conveying belt. The fixing unit is disposed to receive the recording sheet conveyed by the conveying belt and is configured to fix the developer image on the recording sheet by heat. The fixing unit has a top edge portion and a bottom edge portion. The reading unit is provided adjacent to the driving roller and is capable of reading the predetermined pattern formed on the conveying belt. The fan is provided on an upper section of the inner space separated from a lower section of the inner space by an upper part of the conveying belt moving toward the fixing unit. The fan transfers air from inside the casing to outside thereof. The first partition wall is located in the upper section of the inner space. The fan is provided on one side of the first partition wall and the fixing unit on another side thereof. The first partition wall has a bottom end. The bottom end of the first partition wall is positioned below the top edge portion of the fixing unit and above the upper part of the conveying belt. The air inlet port is vertically in a lower position than the fan.

In another aspect of the invention, there is provided an image-forming device including a casing, a driving roller, a conveying belt, a photosensitive unit, a fixing unit, a reading unit, a fan, and an air flow channel. The casing has a wall formed with an air inlet port and defines an inner space. The conveying belt is circularly movably supported on the driving roller and is configured to convey a recording sheet in a sheet conveying direction perpendicular to the axial direction. The photosensitive unit is provided above the conveying belt and has at least one photosensitive drum configured to form a developer image to be transferred onto the recording sheet on the conveying belt. The photosensitive unit is configured to form a predetermined pattern on the conveying belt. The fixing unit is disposed to receive the recording sheet conveyed by the conveying belt and is configured to fix the developer image on the recording sheet by heat. The reading unit is provided adjacent to the driving roller and is configured to read the predetermined pattern formed on the conveying belt. The air flow channel is formed between the air inlet port and the fan. A major part of air introduced into the inner space through the air inlet port is transferred outside the casing by the fan. The reading unit is disposed in the air flow channel. The fixing unit is disposed in a position offset from the air flow channel.

DETAILED DESCRIPTION

An electrophotographic image-forming device according to a first embodiment of the present invention will be described while referring to the accompanying drawings.

Figure 1:
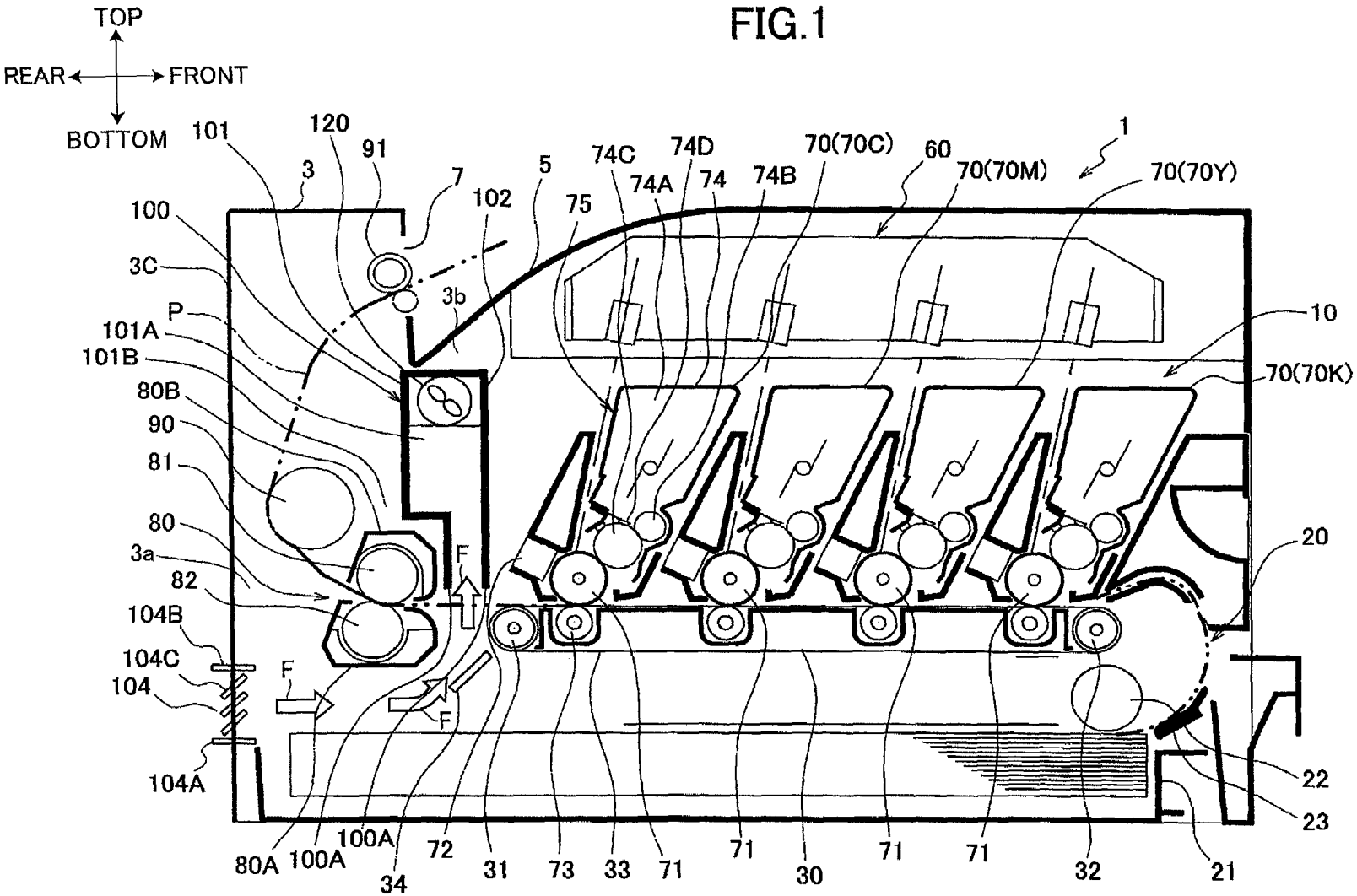
FIG. 1 is a side cross-sectional view showing a main part of a laser printer according to embodiments of the present invention.

In this embodiment, the electrophotographic image-forming device of the present invention is applied to a laser printer 1 shown in FIG. 1. Note that in the following description, the expressions "front," "rear," "left," "right," "above," and "below" are used to define the various parts when the laser printer 1 is disposed in an orientation in which it is intended to be used.

First Embodiment

1. External Configuration of Laser Printer

FIG. 1 is a side cross-sectional view of the laser printer 1. As shown in FIG. 1, the laser printer 1 includes a substantially box-shaped (cubic) casing 3 defining an inner space 3*a*. A discharge tray 5 is formed on the top surface of the casing 3 for receiving a recording sheet, such as paper sheet or OHP sheet, discharged out of the casing 3 after images have been printed thereon.

In this embodiment, a frame member (not shown) formed of metal, resin, or the like, is provided inside the casing 3. A process cartridge 70 and a fixing unit 80 described later are detachably provided to the frame member.

2. Internal Configuration of Laser Printer

The laser printer 1 further includes, within the inner space 3*a* of the casing 3, an image forming unit 10 that forms an image on a recording sheet, a feeder unit 20 that feeds the recording sheet, a belt unit 30 that conveys the recording sheet fed from the feeder unit 20 to four process cartridges 70K, 70Y, 70M, and 70C.

2.1. Feeder Unit

The feeder unit 20 includes a sheet feed tray 21 disposed in the bottommost section of the casing 3, a sheet feed roller 22 disposed above the front end of the sheet feed tray 21 for feeding recoding sheets stacked on the sheet feed tray 21 to the image forming unit 10, and a separation pad 23 for separating recording sheets fed by the feed roller 22 one at a time by applying a predetermined feeding resistance to the recording sheets. A recording sheet fed from the sheet feed tray 21 is changed in a sheet conveying direction by approximately 90 degrees to the upward direction on the front side of the sheet feed tray 21 and then by approximately 90 degrees to the horizontally rearward direction, thereby supplied to the image forming unit 10.

2.2. Belt Unit

The belt unit 30 includes a driving roller 31 that rotates in conjunction with the operation of the image forming unit 10, a driven roller 32 rotatably disposed distant from the driving roller 31, and a conveying belt 33 wound about the driving roller 31 and the driven roller 32.

The driving roller 31 is rotatably supported, in a state that the position of its shaft is fixed, on a frame (not shown) of a belt unit 30. The driven roller 32 is rotatably supported on the frame in a state that the position of its shaft is movable in the front-to-rear direction.

The driven roller 32 is directly or indirectly pressed by an elastic means (not shown) such as a spring, in a direction far from the driving roller 31, so that a predetermined tension is given to the conveying belt 33.

Resist sensors 34 are provided near the driving roller 31 so as to read a correction patch image formed on the conveying belt 33. Each of the resist sensors 34 is an optical sensor which irradiates light such as infrared light on the conveying belt 33 and reads its reflected light.

Figure 2:
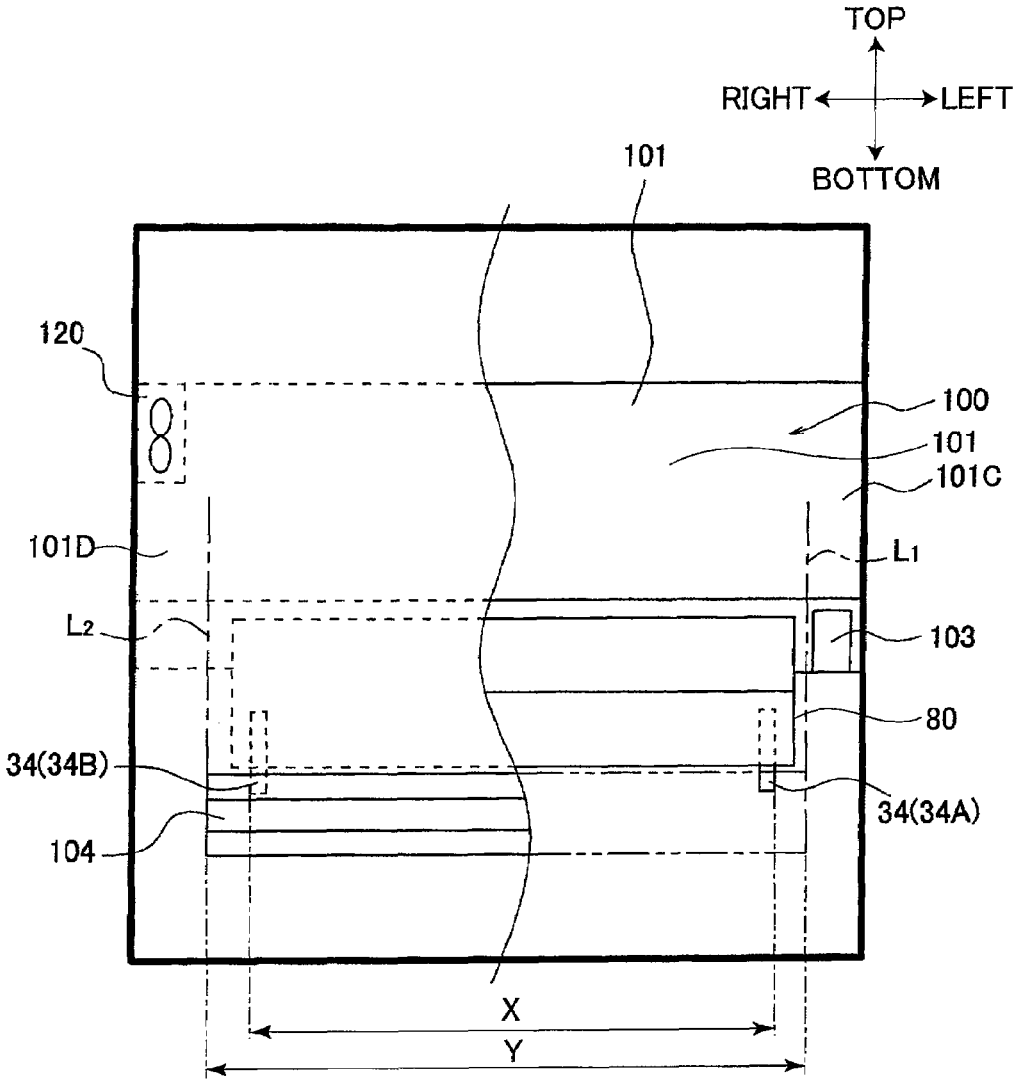
FIG. 2 is a schematic diagram showing a rear side of the laser printer according to a first embodiment of the present invention.

As shown in FIG. 2, the resist sensors 34 are arranged along the left-to-right direction (an axial direction of the driving roller 31). In this embodiment, each resist sensor 34 is provided at each end of the driving roller 31 in the left-to-right direction. The resist sensors 34 irradiate lights on a portion, which the conveying belt 33 comes in contact with the driving roller 31, of the conveying belt 33 so as to read the correction patch image.

The correction patch image is a test pattern for detecting a color shift amount among a plurality of colors. A control unit (not shown) of the laser printer 1 corrects the light-exposure timing by the scanner unit 60 described later based on the color shift amount read by the resist sensors 34.

2.3. Image Forming Unit

The image forming unit 10 includes the scanner unit 60, the process cartridge 70, and the fixing unit 80. The image forming unit 10 is disposed in an upper section 3*b* of the inner space 3*a*. The upper section 3*b* of the inner space 3*a* is separated from a lower section (not labeled) of the inner space 3*a* by an upper part of the conveying belt 33 moving toward the fixing unit 80.

The image forming unit 10 employs the direct tandem system and is capable of printing color images. The developer cartridges 70K, 70Y, 70M, and 70C correspond to developer (toner) of respective colors black, yellow, magenta, and cyan, are arranged along the sheet conveying direction of recording sheets and transfer each developer images on a recording sheet.

The four process cartridges 70K, 70Y, 70M, and 70C have the same configuration except colors of developer. Therefore, the process cartridges 70K, 70Y, 70M, and 70C are collectively referred to as the process cartridge 70.

2.3.1. Scanner Unit

The scanner unit 60 is disposed in the upper section 3*b* of the casing 3 for forming an electrostatic latent image on the surface of each of photosensitive drums 71. Although not shown in the drawings, the scanner unit 60 includes laser emitting sections, polygon mirrors, fθ lenses, reflecting mirrors, and the like.

Each laser emitting section emits a laser beam based on desired image data. The laser beam is reflected by the polygon mirror, passes through the fθ lens, is reflected by the reflecting mirror, and is reflected downward by the reflecting mirror so as to irradiate the surface of the photosensitive drum 71, thereby forming an electrostatic latent image thereon.

2.3.2. Process Cartridge

Hereinafter, the structure of the process cartridge 70 will be described by referring to the process cartridge 70C as an example. The process cartridge 70C is detachably provided below the scanner unit 60 in the casing 3. The process cartridge 70 includes the photosensitive drum 71, a charging unit 72, and a developer accommodating section 74.

The photosensitive drum 71 is for bearing developer images to be transferred onto a recording sheet. The photosensitive drum 71 has a cylindrical shape and its outermost layer is a positively charged photosensitive layer formed of polycarbonate or the like.

The charging unit 72 is disposed diagonally above and rear of the photosensitive drum 71 and is spaced away from the photosensitive drum 71 by a predetermined space so as to avoid direct contact with the photosensitive drum 71.

The charging unit 72 is a Scorotron type charge unit for generating a corona discharge from a tungsten charge wire, for example, to uniformly charge the surface of the photosensitive drum 71 with a positive polarity.

The developer accommodating section 74 is formed with a developer accommodating chamber 74A for accommodating developer. Disposed inside the developer accommodating chamber 74A are a developer supply roller 74B, a developing roller 74C, and a thickness-regulating blade 74D.

The developer accommodated in the developer accommodating chamber 74A is supplied to the developing roller 74C by the rotation of the developer supply roller 74B and is carried on the surface of the developing roller 74C. The thickness-regulating blade 74D regulates the thickness of the layer of the developer on the surface of the developing roller 74C, forming a thin layer of developer having a uniform thickness on the developing roller 27. Then, the developer is supplied to the surface of the photosensitive drum 71 which has been exposed by a laser beam from the scanner unit 60 as described above.

Transfer rollers 73 are rotatably disposed in opposition to the corresponding photosensitive drums 71 via the conveying belt 33. Each of the transfer rollers 73 rotates in association with the rotation of the conveying belt 33.

Each of the transfer rollers 73 is applied with a transfer bias with respect to the photosensitive drum 71 so as to transfer developer carried on the surface of the photosensitive drum 71 onto a printing surface of the recording sheet as the recording sheet passes by the photosensitive drum 71.

2.3.3. Fixing Unit

As shown in FIG. 1, the fixing unit 80 is disposed on the downstream side of and near the driving roller 31 (the belt unit 30) with respect to the sheet conveying direction. The fixing unit 80 is for thermally fixing the developer transferred onto the recording sheet, and is detachably attached to the frame member (not shown).

Specifically, the fixing unit 80 includes a heat roller 81 and a pressure roller 82. The heat roller 81 is disposed on the printing surface side of the recording sheet and applies conveying force to the recording sheet while heating developer clinging on the recording sheet. The pressure roller 82 is disposed in confrontation with the heat roller 81 and presses a recording sheet interposed between the pressure roller 82 and the heat roller 81 against the heat roller 81.

The heat roller 81 rotates in synchronization with a developing roller 74C, the conveying belt 33, and the like. The pressure roller 82 is driven by the heat roller 81 through the rotation of the heat roller 81 via a sheet in contact therewith.

2.4. Exhaust Duct

As shown in FIG. 1, an exhaust duct 100 is provided on the upper section 3*b* of the casing 3 (near a discharge slit 7 or the discharge tray 5 in this embodiment). The exhaust duct 100 guides the air inside the casing 3 to an exhaust fan 120 so that the exhaust fan 120 exhausts the air from the casing 3. In this embodiment, an axial fan (see JIS B 0132 No. 1012) is employed as the exhaust fan 120, where air passes through the fan in its axis direction.

The exhaust duct 100 includes a first partition wall 101 and a second partition wall 102. The first partition wall 101 divides the space inside the casing 3 into an exhaust fan side space 101A where the exhaust fan 120 is provided and a fixing unit side space 101B where the fixing unit 80 is provided. The second partition wall 102 is interposed between the first partition wall 101 and the process cartridge 70 and covers the exhaust fan 120 from above side. The first partition wall 101 and the second partition wall 102 define a ductal exhaust path extending from the lower side to the upper side (exhaust fan 120 side) in the exhaust fan side space 101A. As shown in FIG. 2, the first partition wall 101 has one end portion 101C and another end portion 101D in the left-to-right direction.

Figure 3:
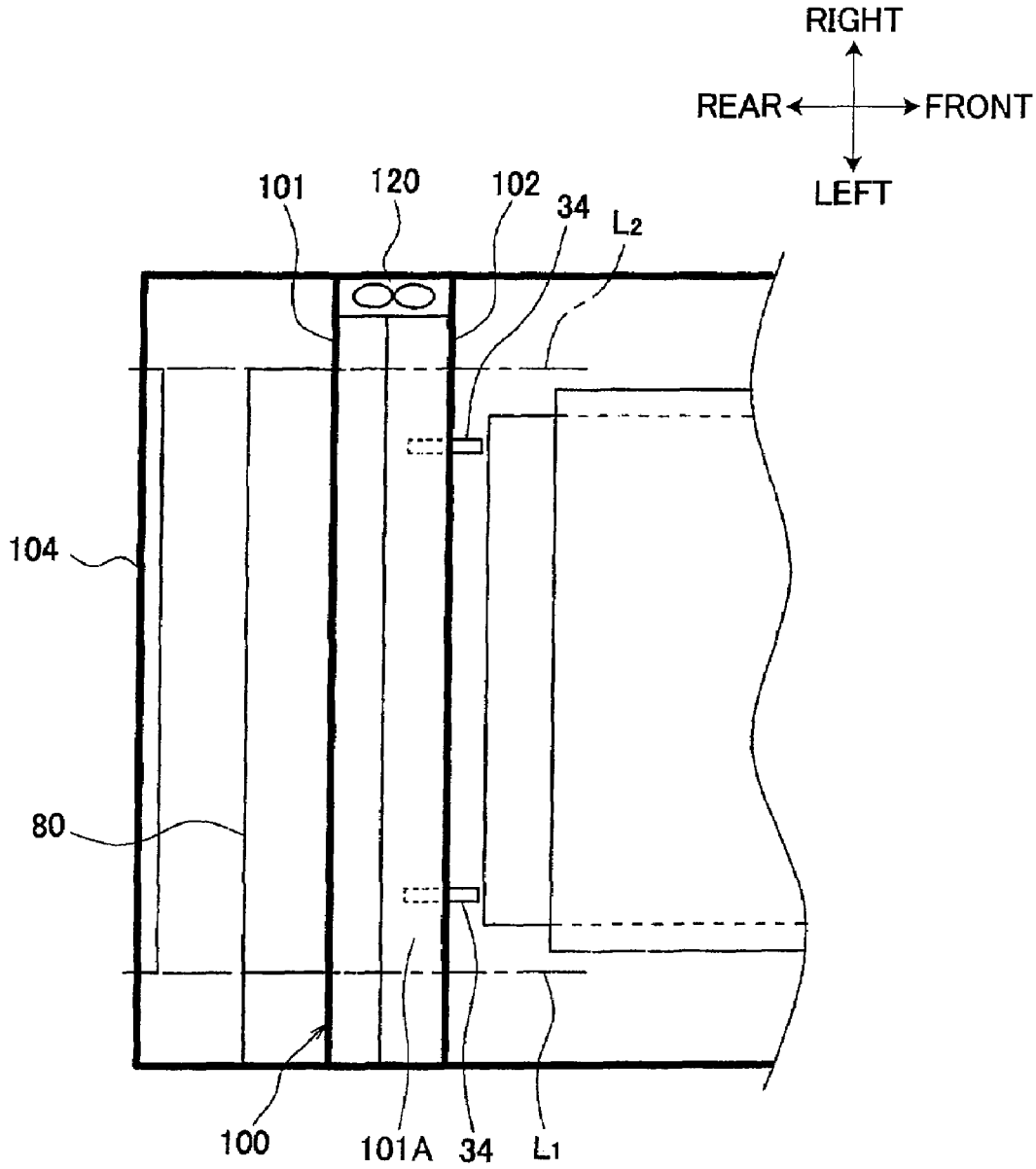
FIG. 3 is a schematic diagram showing a top side of the laser printer according to the first embodiment of the present invention.

As shown in FIGS. 1 and 3, the first partition wall 101 and the second partition wall 102 extend in a direction parallel to the axial direction of the driving roller 31 (the left-to-right direction of the laser printer 1). The first partition wall 101 and the second partition wall 102 divide the space on the upper side of the belt unit 30 within the casing 3 into a space on the fixing unit 80 side and a space on the belt unit 30 side.

As shown in FIG. 1, a lower portion (resist sensor 34 side) of the exhaust duct 100 has an opening and is in communication with the space inside the casing 3. Bottom ends 100A of the first partition wall 101 and the second partition wall 102 (exhaust duct 100) are positioned above a sheet feed path P extending from the conveying belt 33 to the fixing unit 80 and below a top edge portion 80B of the fixing unit 80.

Figure 4A:
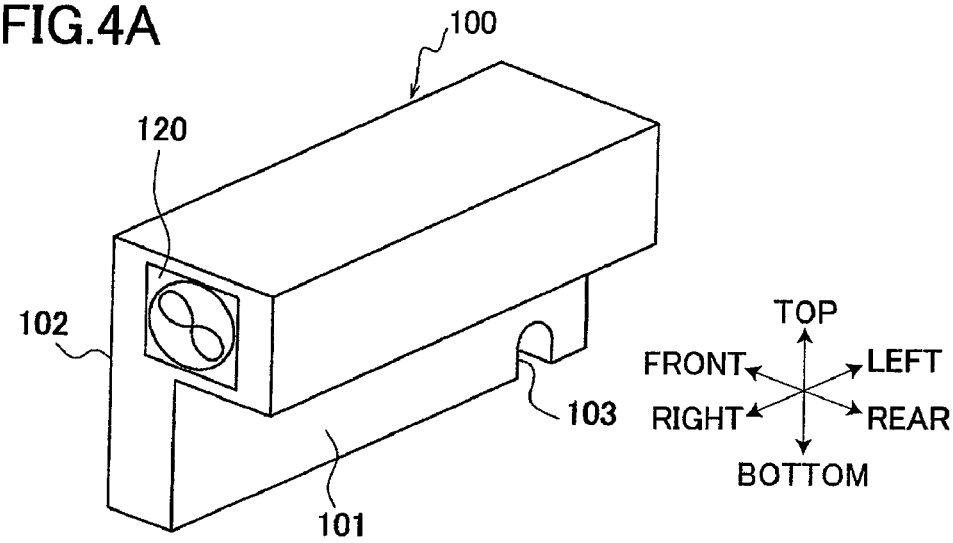
FIGS. 4A-4C are perspective views showing an exhaust duct of the laser printer according to the first embodiment of the present invention.

As shown in FIGS. 3 and 4A, the exhaust fan 120 is provided at the right end in an upper space within the exhaust duct 100 (the exhaust fan side space 101A) in the left-to-right direction (at one end side in the axial direction of the driving roller 31). Hence, the exhaust fan 120 is positioned on the one end portion 101C of the partition wall 101.

Figure 4B:
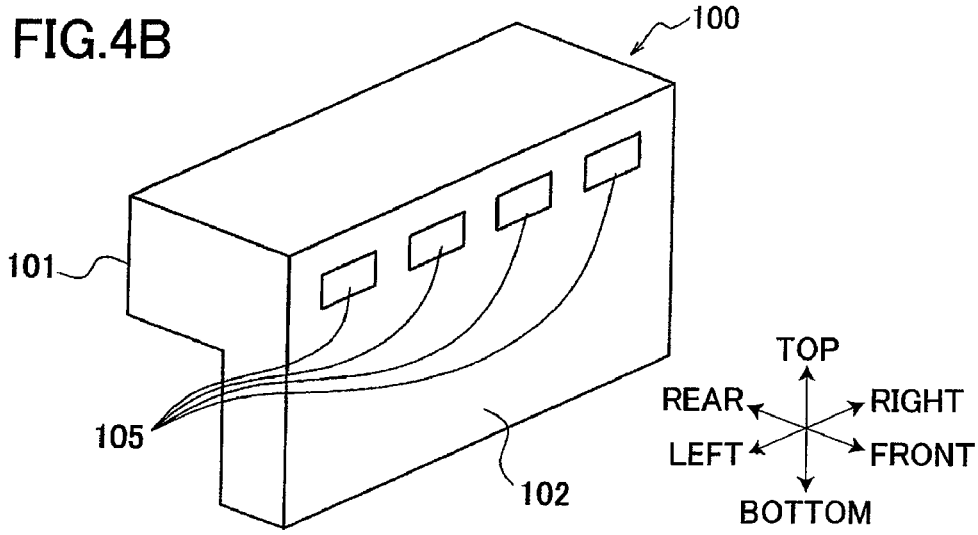
Figure 4C:
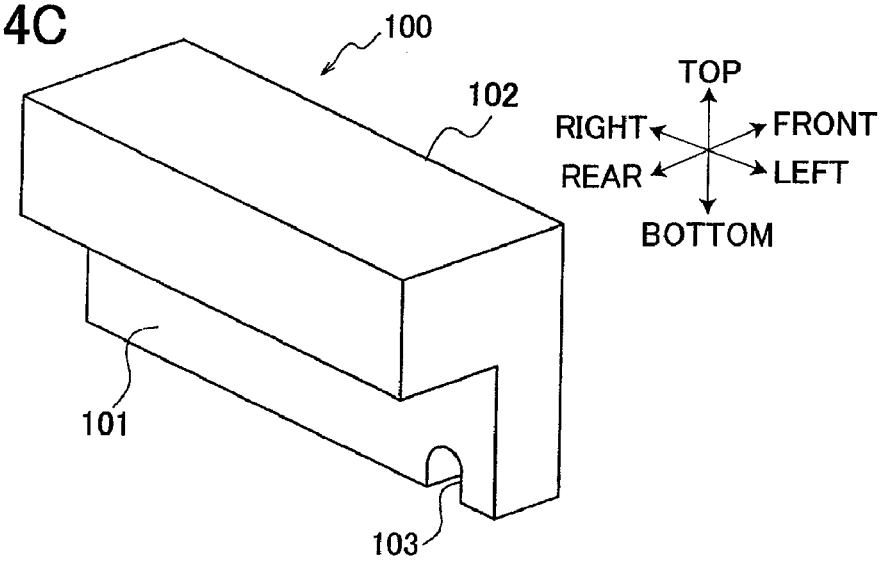

As shown in FIGS. 4A and 4C, in a lower portion of the first partition wall 101, at the left side in the left-to-right direction (at the other end in the axial direction of the driving roller 31), a first connecting hole 103 is formed so as to be in communication with the fixing unit side space 101B and the exhaust fan side space 101A. In other words, the first connecting hole is formed on the lower portion of the another end portion 101D of the first partition wall 101. As shown in FIG. 4B, second connecting holes 105 are formed in an upper portion of the second partition wall 102 so as to be in communication with the exhaust fan side space 101A and the space where the belt unit 30 and the scanner unit 60 are disposed.

In the present embodiment, the first connecting hole 103 is one opening. On the other hand, the second connecting holes 105 are a plurality of openings arranged in a line in the left-to-right direction (a direction parallel to the axial direction of the driving roller 31).

As shown in FIG. 1, an inlet port 104 is formed on a rear side wall 3C of the casing 3 so as to be in communication with the fixing unit side space 101B and the outside of the casing 3. A bottom end portion 104A of the inlet port 104 is positioned below a bottom edge portion 80A of the fixing unit 80. A top end portion 104B of the inlet port 104 is also positioned below the bottom edge portion 80A of fixing unit 80. The inlet port 104 is vertically in a lower position than the exhaust fan 102.

As shown in FIG. 2, the size Y of the inlet port 104 in the left-to-right direction is longer than the distance X between two of the resist sensors 34 in the left-to-right direction. Further, the width of the first partition wall 101 in the left-to-right direction is longer than the size Y.

As shown in FIGS. 2 and 3, two resist sensors 34 are disposed between a left-end reference line L1 which passes the left end of the inlet port 104, and a right-end reference line L2 which passes the right end of the inlet port 104 in the left-to-right direction.

Figure 5:
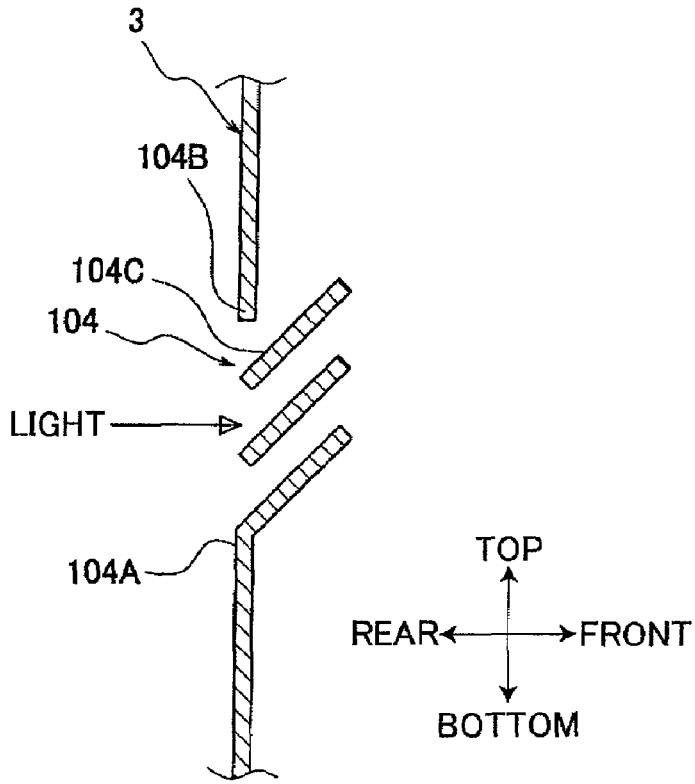
FIG. 5 is a cross-sectional view showing an inlet port of the laser printer according to the embodiments of the present invention.

As shown in FIG. 5, the inlet port 104 includes a plurality of strip louvers 104C, like a louver window. Each of the louvers 104C is inclined relative to the horizontal direction (the front-to-rear direction) so that its rear end is lower than the front end.

3. Feature of the Laser Printer 1 of this Embodiment

In this embodiment, the bottom ends 101A of the first partition wall 101 (exhaust duct 100) are positioned above the sheet feed path P which extends from the conveying belt 33 to the fixing unit 80 and below the top edge portion 80B of the fixing unit 80. Furthermore, the bottom end portion 104A of the inlet port 104 is positioned below the bottom edge portion 80A of the fixing unit 80. This structure allows most of the cooling air taken in the fixing unit side space 101B through the inlet port 104, to flow toward the bottom end 100A of the first partition wall 101, and then to be exhausted from the casing 3 by the exhaust fan 120 after reaching the exhaust fan side space 101A.

Therefore, most of the cooling air, which flows through the inlet port 104 toward the bottom end 100A of the first partition wall 101, passes below the fixing unit 80 to cool the resist sensors 34, without passing through the fixing unit 80, and then reaches the exhaust fan side space 101A. That is, an air flow channel F is formed between the inlet port 104 and the exhaust fan 102, and a major part of the cooling air introduced into the inner space 3*a* through the inlet port 104 is transferred outside the casing 3 by the exhaust fan 102. The resist sensors 34 are disposed in the air flow channel F, and the fixing unit 80 is disposed in a position offset from the air flow channel F. This prevents the fixing unit 80 from being cooled excessively while the resist sensor 34 is cooled adequately.

Since the top end portion 104B of the inlet port 104 is positioned below the bottom end 80A of the fixing unit 80, the cooling air taken through the inlet port 104 is properly guided below the fixing unit 80.

The air heated by the fixing unit 80 is accumulated above the fixing unit 80. Since the cooling air taken through the inlet port 104 is guided below the fixing unit 80, the heated air, which has been accumulated above the fixing unit 80, is prevented from mixing with the cooling air taken through the inlet port 104.

Accordingly, the cooling air can be guided to the resist sensors 34 while the temperature increase of the cooling air taken through the inlet port 104 is prevented, thereby cooling the resist sensors 34 adequately.

Furthermore, the distance X between the two resist sensors 34 (34A and 34B) is shorter than the size Y of the inlet port 104 in the left-to-right direction. Hence, the resist sensors 34 are positioned within the flow path of the cooling air taken through the inlet port 104, thereby cooling the resist sensor 34 adequately.

In the case where the fixing unit 80 is cooled excessively, it becomes impossible to adequately heat the developer image transferred to the recording sheet. On the other hand, in the case where the temperature of the fixing unit 80 rises too high, the fixing unit 80 is subject to heat damage.

In response, the first connecting hole 103 is formed in the first partition wall 101 so as to be in communication with the fixing unit side space 101B and the exhaust fan side space 101A. Hence, a part of the heated air which has been accumulated in the fixing unit side space 101B can be exhausted from the casing 3.

Hence, the fixing unit 80 is cooled adequately, thereby preventing the temperature of the fixing unit 80 from rising too high.

Furthermore, the second connecting holes 105 are formed in the second partition wall 102. The air which has been accumulated above the process cartridge 70 can be efficiently exhausted from the casing 3 through the second connecting holes 105. Also, the bottom end 100A of the second partition wall 102 is positioned above the sheet feed path P and below the top edge portion 80B of the fixing unit 80. The air which has been accumulated near the belt unit 30 can be exhausted from the casing 3 efficiently.

In this embodiment, since the inlet port 104 is provided in a lower portion of the casing 3, external light is likely to enter through the inlet port 104 from above relative to the horizontal direction. In response to this situation, the inlet port 104 is formed of a louver window. Further, each of the louvers 104C is inclined relative to the horizontal direction (the front-to-rear direction) so that its rear end is positioned lower than the front end. Accordingly, the louvers 104C can cut off incoming light properly and the resist sensor 34 can read the correction patch image consistently.

Second Embodiment

Figure 6:
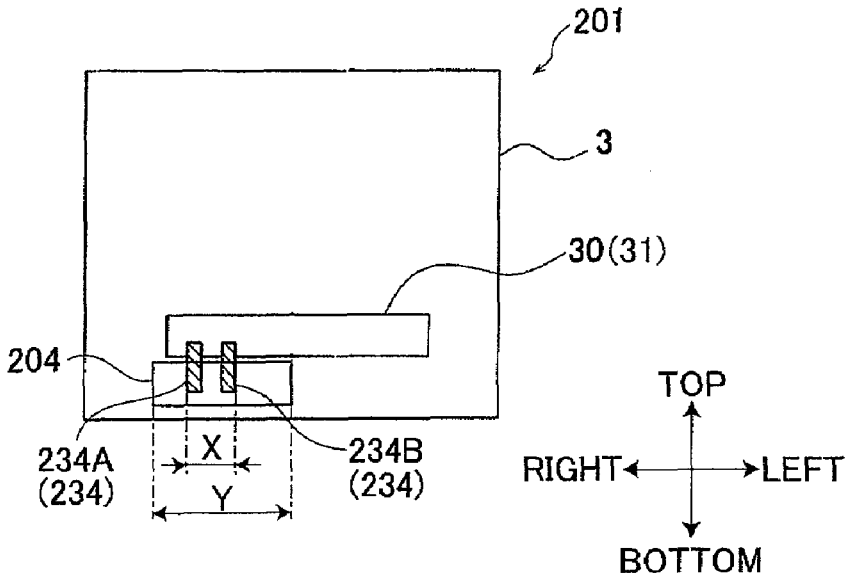
FIG. 6 is a schematic diagram showing a rear side of a laser printer according a second embodiment of the present invention.

Next, a second embodiment of the present invention will be described while referring to FIG. 6. FIG. 6 is a schematic diagram showing the rear side of a laser printer 201. In the first embodiment, two resist sensors 34 are provided next to both ends of the driving roller 31 in its axial direction (the left-to-light direction), respectively. In this embodiment, however, two resist sensors 234 are provided on the right end side of the driving roller 31 in the left-to-right direction.

In this embodiment, the size Y of the inlet port 204 in the left-to-right direction is longer than the distance X between the two resist sensors 234 (234A and 234B) in the left-to-right direction.

As shown in FIG. 6, in this embodiment, the two resist sensors 234 are positioned on one side in the left-to-right direction of the driving roller 31. The size Y of the inlet port 204, therefore, is shorter than the size of the belt unit 30 in the left-to-right direction. However, the present invention is not limited to this case. The size Y of the inlet port 204 may be longer than the size of the belt unit 30 in the left-to-right direction.

Third Embodiment

Figure 7:
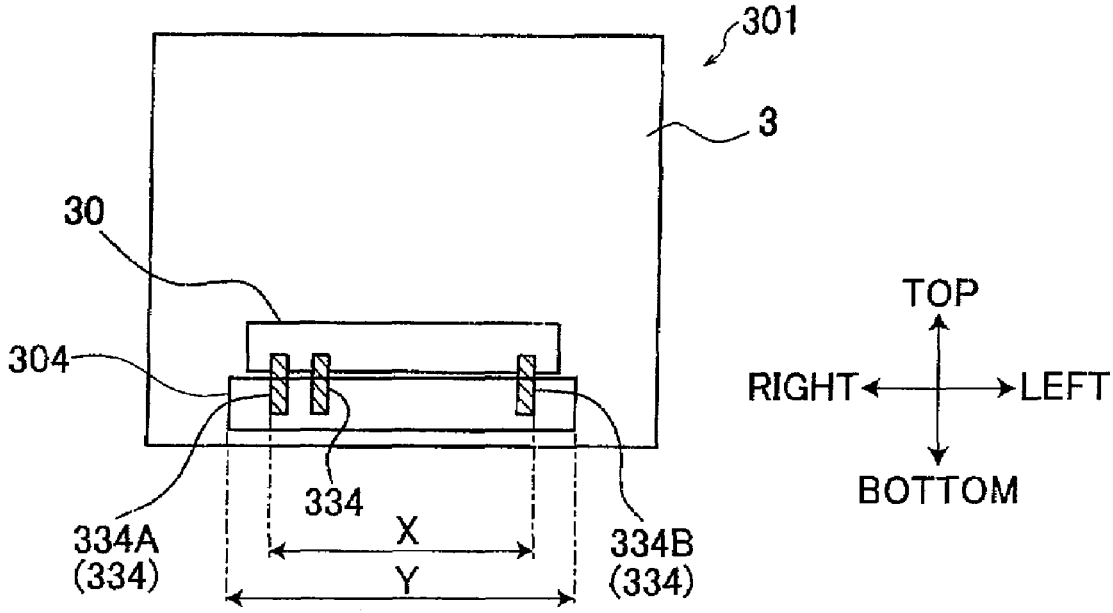
FIG. 7 is a schematic diagram showing a rear side of a laser printer according to a third embodiment of the present invention.

Next, a third embodiment of the present invention will be described while referring to FIG. 7. FIG. 7 is a schematic diagram showing the rear side of a laser printer 301. Although the above embodiments employ two resist sensors 34 and 234, respectively, three resist sensors 334 are employed in this embodiment.

As shown in FIG. 7, the size Y of the inlet port 304 in the left-to-right direction is longer than the distance X between a rightmost resist sensor 334A and a leftmost resist sensor 334B of the three resist sensors 334.

While the invention has been described in detail with reference to specific embodiments thereof, it would be apparent to those skilled in the art that many modifications and variations may be made therein without departing from the spirit of the invention, the scope of which is defined by the attached claims.

While the exhaust duct 100 includes the second partition wall 102 as well as the first partition wall 101 in the preferred embodiments described above, the present invention is not limited to this construction. The second partition wall 102 may be omitted.

While the first connecting hole 103 and the second connecting holes 105 are formed in the first partition wall 101 and the second partition wall 102, respectively, in the preferred embodiments described above, the present invention is not limited to this construction. The first connecting hole 103 and the second connecting holes 105 may be omitted.

While the exhaust fan 120 is provided only at one end in the upper space within the exhaust duct 100 in the left-to-right direction (the axial direction of the driving roller 31), the present invention is not limited to this construction. Two exhaust fans 120 may be provided at both ends in the upper space in the left-to-right direction.

While an axial fan is employed as the exhaust fan 120 in the preferred embodiments described above, the present invention is not limited to this construction. For example, a centrifugal multiblade fan (see JIS B 0132 No. 1004) such as a turbo fan or a silocco fan; or a cross flow fan (see JIS B 0132 No. 1017) may be employed.

While the resist sensor 34 having an optical sensor is employed as a reading unit in the preferred embodiments described above, the present invention is not limited to this construction. For example, a density sensor, which detects the density of the correction patch image formed on the conveying belt 33, may be employed as a reading sensor.

While the louvers 104C are provided in the inlet port 104 in the preferred embodiments described above, the present invention is not limited to this construction. For example, a net-like member having a multitude of holes may be provided in the inlet port 104.

The inclination and longitudinal directions of the louvers 104C are not limited to the directions shown in FIG. 5. In the case where a protrusion is provided on the top side or bottom side of the outer surface of the fixing unit casing which contains the heat roller 81 and the pressure roller 82 of the fixing unit 80, the top edge portion 80B of the fixing unit 80 indicates a portion near the root of the protrusion provided on the top side of the outer surface. Similarly, the bottom edge portion 80A of the fixing unit 80 indicates a portion near the root of the protrusion provided on the bottom side of the outer surface.

What is claimed is:

1. An image-forming device comprising:

a casing that has a wall formed with an air inlet port and defines an inner space, the air inlet port having a top end portion and a bottom end portion;

a driving roller that is provided in the casing and defines an axial direction;

a conveying belt that is movably supported on the driving roller and is configured to convey a recording sheet in a sheet conveying direction perpendicular to the axial direction;

a photosensitive unit that is provided above the conveying belt and has at least one photosensitive drum configured to form a developer image to be transferred onto the recording sheet on the conveying belt, the photosensitive unit being configured to form a predetermined pattern on the conveying belt;

a fixing unit that is disposed to receive the recording sheet conveyed by the conveying belt and is configured to fix the developer image on the recording sheet by heat, the fixing unit having a top edge portion and a bottom edge portion;

a reading unit that is provided adjacent to the driving roller and is configured to read the predetermined pattern formed on the conveying belt;

a fan that is provided in an upper section of the inner space separated from a lower section of the inner space by an upper part of the conveying belt moving toward the fixing unit, the fan configured to transfer air from inside the casing to outside thereof; and a first partition wall that is located in the upper section of the inner space, the fan being provided on one side of the first partition wall and the fixing unit being provided on another side thereof, the first partition wall having a bottom end, wherein the bottom end of the first partition wall is positioned below the top edge portion of the fixing unit and above the upper part of the conveying belt, and the air inlet port is vertically in a lower position than the fan, and wherein the air inlet portion is configured to direct air below the bottom edge portion of the fixing unit toward the reading unit.

2. The image-forming device according to claim 1, wherein the photosensitive unit has a plurality of photosensitive drums arranged along the sheet conveying direction, each of the plurality of photosensitive drums being configured to form a developer image to be transferred onto the recording sheet on the conveying belt.

3. The image-forming device according to claim 1, wherein the top end portion of the air inlet port is positioned below the bottom edge portion of the fixing unit.

4. The image-forming device according to claim 1, wherein the reading unit includes a plurality of reading sensors arranged along the axial direction, the plurality of reading sensors having a first sensor disposed in confrontation with one end portion of the driving roller and a second sensor disposed in confrontation with another end portion of the driving roller, a distance between the first sensor and the second sensor in the axial direction being shorter than a length of the air inlet port in a direction parallel to the axial direction.

5. The image-forming device according to claim 4, wherein a width of the partition wall in the direction parallel to the axial direction is longer than the length of the air inlet port.

6. The image-forming device according to claim 5, wherein the fan is provided above the one end portion of the driving roller, the first partition wall having one end portion and another end portion in the axial direction wherein the fan is provided at the one end portion of the first partition wall, and the another end portion of the first partition wall is formed with a connecting hole for allowing the one side and the another side of the first partition wall to be in fluid communication with each other.

7. The image-forming device according to claim 1, wherein the reading unit includes an optical sensor, and the air inlet port includes a plurality of strip louvers forming a louver window.

8. The image-forming device according to claim 7, wherein each of the plurality of strip louvers has an inner edge and an outer edge and is inclined with respect to a horizontal direction, the outer edge being positioned below the inner edge.

9. The image-forming device according to claim 1, farther comprising a second partition wall provided between the first partition wall and the photosensitive unit and covering the fan, the first partition wall and the second partition wall forming a duct.

10. An image-forming device comprising:

a casing that has a wall formed with an air inlet port and defines an inner space;

a driving roller;

a conveying belt that is movably supported on the driving roller and is configured to convey a recording sheet in a sheet conveying direction perpendicular to the axial direction;

a photosensitive unit that is provided above the conveying belt and has at least one photosensitive drum configured to form a developer image to be transferred onto the recording sheet on the conveying belt, the photosensitive unit being configured to form a predetermined pattern on the conveying belt;

a fixing unit that is disposed to receive the recording sheet conveyed by the conveying belt and is configured to fix the developer image on the recording sheet by heat;

a reading unit that is provided adjacent to the driving roller and is configured to read the predetermined pattern formed on the conveying belt;

a fan; and an air flow channel formed between the air inlet port and the fan, a majority of air introduced into the inner space through the air inlet port being transferred outside the casing by the fan, wherein the reading unit is disposed in the air flow channel, the fixing unit is disposed in a position offset from the air flow channel, and the air inlet portion is configured to direct air below the bottom edge portion of the fixing unit toward the air flow channel.

11. The image-forming device according to claim 10, wherein the air flow channel comprises a partition wall that is configured to guide the majority of air toward the fan.

12. The image-forming device according to claim 10, wherein the air flow channel comprises a partition wall that partitions the fixing unit at least partially from the air flow channel.

13. The image-forming device according to claim 10, wherein the air flow channel comprises a duct.

14. The image-forming device according to claim 1, wherein the reading unit includes a plurality of reading sensors arranged along the axial direction, the plurality of reading sensors including a first sensor disposed in confrontation with one end portion of the driving roller and a second sensor disposed in confrontation with another end portion of the driving roller, a length of the air inlet port in a direction parallel to the axial direction being longer than a distance between the first sensor and the second sensor in the axial direction.

15. The image-forming device according to claim 9, wherein the duct has an opening that opens toward the reading unit.

16. An image-forming device comprising:

a casing that has a wall formed with an air inlet port and defines an inner space, the air inlet port having a top end portion and a bottom end portion;

a driving roller that is provided in the casing and defines an axial direction;

a conveying belt that is movably supported on the driving roller and is configured to convey a recording sheet in a sheet conveying direction perpendicular to the axial direction;

a photosensitive unit that is provided above the conveying belt and has at least one photosensitive drum configured to form a developer image to be transferred onto the recording sheet on the conveying belt, the photosensitive unit being configured to form a predetermined pattern on the conveying belt;

a fixing unit that is disposed to receive the recording sheet conveyed by the conveying belt and is configured to fix the developer image on the recording sheet by heat, the fixing unit having a top edge portion and a bottom edge portion;

a reading unit that is provided adjacent to the driving roller and is configured to read the predetermined pattern formed on the conveying belt;

a fan that is provided in an upper section of the inner space separated from a lower section of the inner space by an upper part of the conveying belt moving toward the fixing unit, the fan configured to transfer air from inside the casing to outside thereof; and a first partition wall that is located in the upper section of the inner space, the fan being provided on one side of the first partition wall and the fixing unit being provided on another side thereof, the first partition wall having a bottom end, wherein the bottom end of the first partition wall is positioned below the top edge portion of the fixing unit and above the upper part of the conveying belt, and the air inlet port is vertically in a lower position than the fan, and wherein the reading unit includes a plurality of reading sensors arranged along the axial direction, the plurality of reading sensors having a first sensor disposed in confrontation with one end portion of the driving roller and a second sensor disposed in confrontation with another end portion of the driving roller, a distance between the first sensor and the second sensor in the axial direction being shorter than a length of the air inlet port in a direction parallel to the axial direction.

17. The image-forming device according to claim 16, wherein a width of the partition wall in the direction parallel to the axial direction is longer than the length of the air inlet port.

18. The image-forming device according to claim 16, wherein the fan is provided above the one end portion of the driving roller, the first partition wall having one end portion and another end portion in the axial direction wherein the fan is provided in the one end portion of the first partition wall, and the another end portion of the first partition wall is formed with a connecting hole for allowing the one side and the another side of the first partition wall to be in fluid communication with each other.

19. The image-forming device according to claim 16, wherein the reading unit includes an optical sensor and the air inlet port includes a plurality of strip louvers forming a louver window.

20. The image-forming device according to claim 19, wherein each of the plurality of strip louvers has an inner edge and an outer edge and is inclined with respect to a horizontal direction, the outer edge being positioned below the inner edge.

21. The image-forming device according to claim 16, further comprising a second partition wall provided between the first partition wall and the photosensitive unit and covering the fan, the first partition wall and the second partition wall forming a duct, the duct having an opening that opens toward the reading unit.

* * * * *